US005993323A

United States Patent [19]

Linenfelser

[11] Patent Number: 5,993,323

[45] Date of Patent: Nov. 30, 1999

[54] GOLF TRAINING APPARATUS

[75] Inventor: Robert Linenfelser, Alton, Ill.

[73] Assignee: Golf Tutor, inc., Manchester, Mo.

[21] Appl. No.: 09/140,054

[22] Filed: Aug. 26, 1998

[51] Int. Cl.[6] ..... A63B 69/36

[52] U.S. Cl. ..... 473/209; 473/211

[58] Field of Search ..... 473/209, 211

[56] References Cited

U.S. PATENT DOCUMENTS

| | | | |
|---|---|---|---|
| 3,770,280 | 11/1973 | Straus | 473/209 |
| 4,502,035 | 2/1985 | Obenauf et al. | 340/323 B |
| 4,560,166 | 12/1985 | Emerson | 273/183 B |
| 4,869,509 | 9/1989 | Lee | 273/183 B |
| 5,108,104 | 4/1992 | Johnson | 273/183 B |
| 5,251,902 | 10/1993 | Federowicz et al. | 273/187.2 |
| 5,284,345 | 2/1994 | Jehn | 273/187.2 |
| 5,524,894 | 6/1996 | Shannon | 473/209 |
| 5,553,857 | 9/1996 | Fish | 473/209 |
| 5,558,585 | 9/1996 | Nolan, Jr. | 473/211 |
| 5,577,729 | 11/1996 | Sabour | 273/274 |
| 5,599,239 | 2/1997 | Kim et al. | 473/208 |

*Primary Examiner*—George J. Marlo

*Attorney, Agent, or Firm*—Senniger, Powers, Leavitt & Roedel

[57] ABSTRACT

Apparatus for detecting head movement of a golfer relative to an address position. The apparatus includes a movement switch positioned on the golfer's head which provides a signal indicative of head movement from a first position to a second position. The position of the movement switch on the golfer defines the first position as approximately the address position prior to the golf swing. The apparatus also includes a transducer which detects the sound of a golf club striking a ball and provides a signal in response thereto. A microcontroller becomes active in response to the transducer signal and then generates an alarm signal in response to the movement switch signal. In response to the alarm signal, the transducer produces an audible alarm to inform the golfer of the head movement during the golf swing. The apparatus has a housing with a clip for securing it to a hat worn by the golfer. The clip is biased toward a closed position and moveable from the closed position to an open position for engaging the hat. When the clip is in its open position, the clip closes a power switch in the housing. The power switch is connected in series between the microcontroller and a battery so that the microcontroller is connected to the battery when the power switch is closed.

9 Claims, 2 Drawing Sheets

GOLF TRAINING APPARATUS

BACKGROUND OF THE INVENTION

This invention relates generally to a golf training aid and, particularly, to an apparatus for detecting excessive head movement during a golfer's swing.

In golf, excessive head movement during the backswing can cause, or is indicative of, a flawed swing pattern which will often result in an undesirable golf shot. For example, straightening the body in the pelvic region during the backswing tends to flatten the club's swing path. A flattened swing path moves the clubhead out of its proper plane during its course through the ball and will likely result in the neck of the club making contact with the ball rather than the face of the club. This type of golf shot will often produce a "shank" which is, perhaps, the most offensive word in golf. In contrast, the golfer can cure this common cause of shanking by maintaining the suspension point at the base of the neck relatively motionless during the golf swing. Thus, a training aid is desired for assisting the golfer at maintaining his or her head position during the golf swing.

U.S. Pat. Nos. 4,502,035, 4,560,166, 4,869,509, 5,108,104, 5,251,902, 5,524,894, 5,558,585, 5,577,729 and 5,599,239, the entire disclosures of which are incorporated by reference herein, disclose various head movement detectors for use by a golfer. In U.S. Pat. No. 4,869,509, for example, a golfer's training aid audibly signals improper head motion during a golf swing using a mercury sensing switch for motion sensing. Nevertheless, an improved golf training aid which is responsive to the sound of a club striking a golf ball and which incorporates improved battery saving and programming features is desired.

SUMMARY OF THE INVENTION

The invention meets the above needs and overcomes the deficiencies of the prior art by providing an improved apparatus for selectively detecting undesirable head movement by a golfer during his or her golf swing. A movement detection circuit that provides a "ready" mode for conserving power and extended battery life accomplishes this. Among the several objects of the invention is also the provision of such a movement detection circuit that is responsive to the sound of the club striking the ball to further conserve battery power. In addition, such apparatus is programmable, economically feasible and commercially practical.

Briefly described, an apparatus embodying aspects of the invention selectively detects undesirable head movement of a golfer swinging a golf club to strike a ball. The apparatus detects the undesirable head movement relative to an address position from which the golfer begins the swing and includes a movement switch positioned on the golfer's head. The movement switch provides a signal indicative of movement of the golfer's head from a first position to a second position. The position of the movement switch on the golfer's head defines the first position as approximately the address position of the golfer's head prior to swinging the golf club. The apparatus also includes a transducer for detecting the sound of the golf club striking the ball and providing a signal in response thereto. A microcontroller receives the transducer signal and becomes active in response to the signal when the golf club strikes the ball. The active microcontroller then generates an alarm signal in response to the movement switch signal indicating movement of the golfer's head from the first position to the second position. In turn, the transducer produces an audible alarm in response to the alarm signal generated by the microcontroller to inform the golfer of the undesirable head movement during the golf swing.

Generally, another form of the invention is also directed to an apparatus for selectively detecting undesirable head movement of a golfer swinging a golf club to strike a ball. The apparatus detects the undesirable head movement relative to an address position from which the golfer begins the swing. In this instance, the apparatus includes a housing which has a clip for securing it to a hat worn on the golfer's head. The clip is biased toward a closed position and moveable from the closed position to an open position for engaging the golfer's hat and securing the housing to it. A movement switch in the housing provides a signal indicative of movement of the housing from a first position to a second position. The movement switch is positioned within the housing and the housing is secured to the hat on the golfer's head to define the first position as approximately the address position of the golfer's head prior to swinging the golf club. The apparatus also includes a microcontroller which generates an alarm signal in response to the movement switch signal indicating movement of the golfer's head from the first position to the second position. When the clip is in its open position, the clip closes a power switch in the housing. The power switch is connected in series between the microcontroller and a battery so that the microcontroller is connected to the battery for supplying power to the microcontroller when the power switch is closed. In turn, a transducer produces an audible alarm in response to the alarm signal generated by the microcontroller to inform the golfer of the undesirable head movement during the golf swing.

Alternatively, the invention may comprise various other methods and systems.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF PREFERRED EMBODIMENTS

Figure 1:
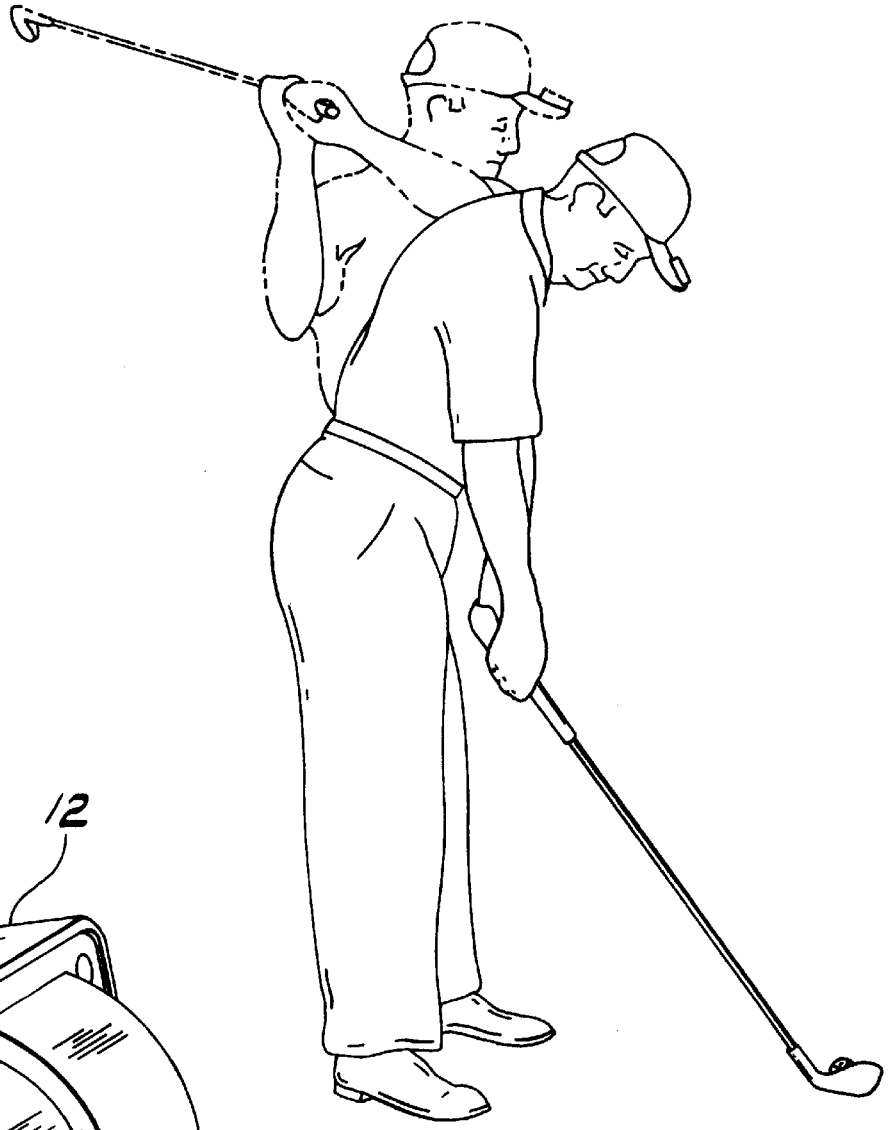
FIG. 1 illustrates a golf training apparatus in use by a golfer during a golf swing for detecting unwanted head movement according to a preferred embodiment of the invention.

Referring now to FIG. 1, an apparatus 10 embodying aspects of the invention is shown in use by a golfer addressing a golf ball. In general, the apparatus 10 includes a housing 12 that is adapted to be attached to a hat 14 worn by the golfer. For example, the housing 12 is clipped to the bill of the hat 14. FIG. 1 also illustrates the golfer in phantom to show an example of an undesirable backswing in which the golfer has lifted his head. As described above, excessive head movement relative to the address position can cause, or is indicative of, a flawed swing pattern which will often result in an undesirable golf shot. In this example, the golfer has straightened up during the backswing which has caused vertically upward movement of his head. In addition, the angle of the golfer's head with respect to vertical has also changed. According to the present invention, apparatus 10 detects excessive head movement by the golfer and provides feedback to aid in preventing such movement on future golf swings.

Figure 2:
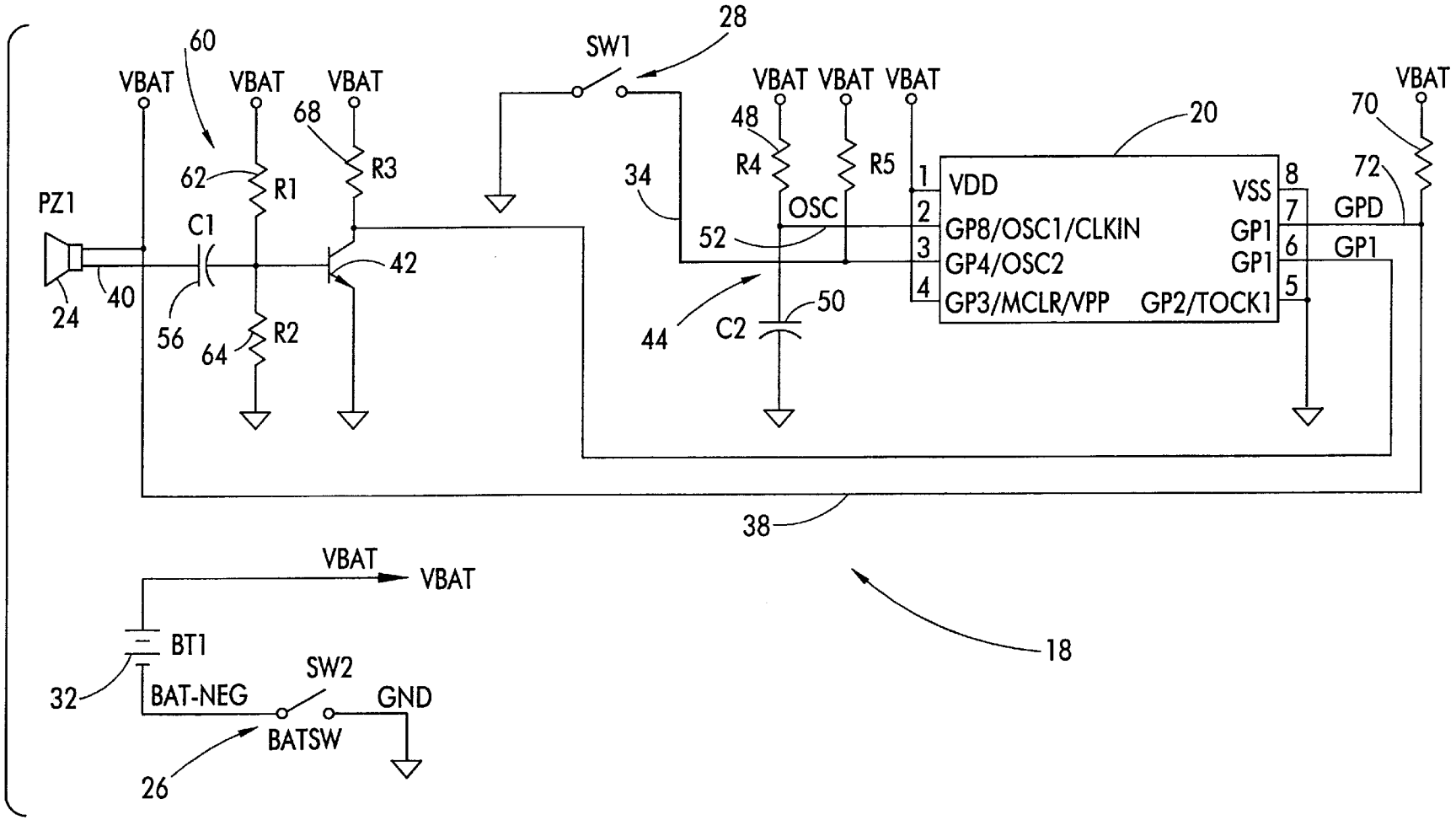
FIG. 2 is a schematic diagram of the golf is training apparatus of FIG. 1.

FIG. 2 is a schematic diagram of a preferred movement detection circuit 18 for use with apparatus 10. As shown, the circuit 18 has a microcontroller 20 connected to an electro-acoustic transducer 24, a power switch 26 and a movement switch 28. When the power switch 26 is closed, a battery 32 (e.g., a coin-type 3V lithium battery) supplies power to the movement detection circuit 18 to place it in a "ready" mode. Although circuit 18 as a whole is in the "ready" mode, the microcontroller 20 remains in a "sleep" mode to conserve power. As an example, a suitable microcontroller is model number PIC12C508-04/SM available from Microchip.

According to the invention, movement detection circuit 18 is responsive to the golf club striking the ball during the golfer's downswing. The transducer 24 is preferably a piezoelectric element that functions as both a microphone and a speaker. In this instance, the piezoelectric element of transducer 24 detects the sound made when the club strikes the ball. Microcontroller 20 becomes active, or "wakes up", in response to the sound and then reads the state of movement switch 28. As an example, transducer 24 is embodied by a piezoelectric element such as model number PKM13EPP-4002 available from Murata.

Movement switch 28 will be closed at impact in this embodiment if the golfer lifted his head by an undesirable amount during the golf swing. For example, if movement switch 28 is a mercury switch, this is accomplished by positioning movement switch 28 at an angle within the housing 12. The angle is such that movement switch 28 is open when the golfer's head is at or near the address position. In this manner, the angle determines the amount of head movement that will trigger the mercury switch so that it will only be closed if the golfer pulled his head up during the swing. Generally, any head movement sufficient to move the mercury contained in the switch 28 may cause the contacts to become closed, as in the targeted "head up position".

In a preferred embodiment, movement switch 28 is a mercury switch such as model number A1/2S-4859 available from American Electronic Components, Inc. It is contemplated, however, that movement switch 28 may be another type of switch, such as a momentum switch or a "ball-in-tube" arrangement, without deviating from the scope of the invention. In a ball-in-tube switch, the principle of operation is based on a metallic ball rolling along a tube (or other suitable track) with the change in angle or tilt. At the end of the track is a set of contacts that are made upon mating with the ball.

In operation, microcontroller 20 responds to the combination of two events. First, the mercury switch of movement switch 28 closes and provides a first signal via line 34. The first signal constitutes a movement signal which is representative of the state of movement switch 28. In other words, the movement signal is indicative of the golfer's head lifting by an undesirable amount during the golf swing. Second, the piezoelectric element of transducer 24, operating as a microphone, detects the sound of the golf club striking the ball and provides a second signal via line 36. The second signal constitutes an enabling or activating signal for "waking" microcontroller 20. Microcontroller 20 energizes the piezoelectric element of transducer 24 via line 38 to emit an audible alarm (e.g., three short beeps of sound) in response to the first and second signals via lines 34 and 36, respectively. In turn, the alarm alerts the golfer of the potential swing flaw. Upon completion of the three short beeps, the microcontroller 20 returns to its sleep mode until re-awakened by the sound of a club striking another ball. By triggering off of the detected sound, the present invention avoids false signaling and conserves the battery 32 between swings. Further, if the golfer lifts his head but returns it to the original position before impact, the alarm will not sound.

The microcontroller 20 preferably performs a timing function implemented in firmware to validate the closure of movement switch 28. Upon waking up (due to the club face striking the golf ball), microcontroller 20 checks the state of movement switch 28 several times (with a slight delay between checks) to ensure the switch closure is valid (e.g., closed for at least a few milliseconds).

As described above, piezoelectric transducer 24 serves as a dual mode device, namely, sensing sound in one mode and emitting sound in another. Upon sensing a sufficient level of sound from the impact of the golf club with the ball, transducer 24 outputs a low level signal at its terminal 40. It is understood by those skilled in the art to either approximate a threshold sound level for detection or empirically derive it using a peak-reading sound measuring device.

A transistor 42 amplifies the low level signal to provide the "wake up" signal to microcontroller 20 via line 36. At this instant, microcontroller 20 executes a program to read the position of movement switch 28 via line 34. If the golfer's head is no longer in the desired position (i.e., at or near the position at address), the mercury switch of movement switch 28 will be closed. In response thereto, microcontroller 20 will pulse transducer 24 with an alarm signal via line 38 to issue an audible alarm. In this instance, a preferred alarm consists of pulsing transducer 24 at approximately 2 kHz to sound three relatively short beeps. This serves as an aural indication to the golfer that his head was not in the desired position when he struck the ball.

Referring further to FIG. 2, an RC network 44 made up of a resistor 48 and a capacitor 50 sets the main clock oscillator frequency for microcontroller 20 via line 52. As an example, microcontroller 20 operates at a nominal frequency of approximately 200 kHz. This provides a sufficient frequency for pulsing the piezoelectric element of transducer 24 without allowing microcontroller 20 to draw unwanted excess current.

As described above, the transistor 42 amplifies the low level output from transducer 24 indicative of club impact. In one embodiment, a capacitor 56 AC couples the output at line 40 to the base of the transistor 42 and establishes the sensitivity of transducer 24 when it is serving as a sound sensor. Also, a voltage divider network 60 made up of resistors 62, 64 biases the base of transistor 42 while a resistor 68 serves as a pull-up resistor for the collector of transistor 42.

With respect to microcontroller 20, a resistor 70 pulls up a floating input GPO at line 72. To aid in reducing circuit current drain, microcontroller 20 is programmed to remain in a sleep mode until awakened by activity on an input GP1 at line 36. According to the invention, this occurs when transducer 24 senses a sound of sufficient level.

Figure 3:
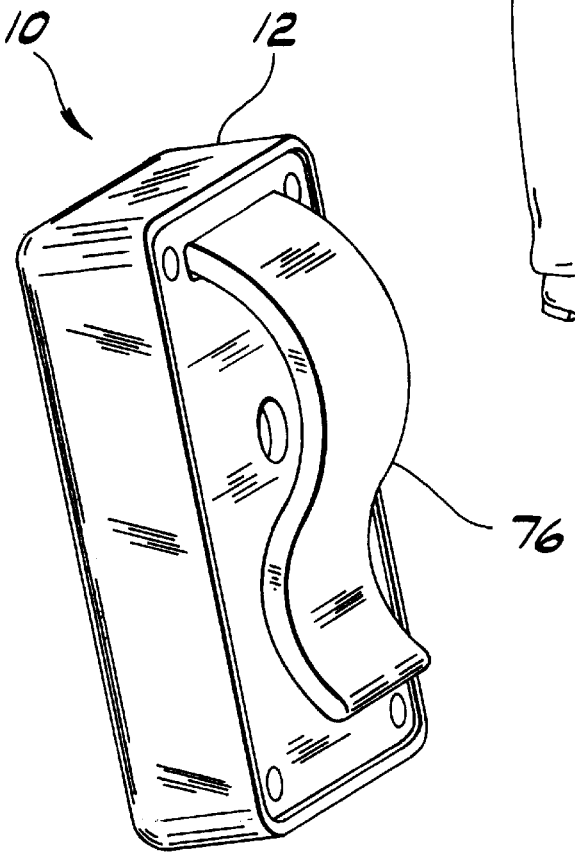
FIG. 3 is a perspective view of a housing for the golf training apparatus of FIG. 1.

Referring now to FIG. 3, the circuit 18 of FIG. 2 is preferably mounted on a printed circuit board assembly secured within housing 12 (e.g., a plastic enclosure). A clip 76 on housing 12 engages the golfer's hat 14 during use to hold apparatus 10 in place. In a preferred embodiment of the invention, the power switch 26 projects through housing 12 and underlies the clip 76. Clip 76 is biased toward housing 12 so that securing housing 12 to hat 14 deflects clip 76 (i.e., biases it away from housing 12) which in turn activates power switch 26 to energize the movement detection circuit 18. This puts circuit 18 in the "ready" mode while microcontroller 20 remains in the "sleep" mode and helps to increase the life of battery 32. Preferably, clip 76 is an integral part of the lower half of housing 12 for securing it to the bill of hat 14. In this embodiment, housing 12 has a small opening through which a raised portion of power switch 26 protrudes. When housing 12 is not clipped to hat 14, the raised portion of power switch 26 is free to extend through the opening in the housing 12, thus deactivating apparatus 10. Upon insertion of a portion of hat 14 into clip 76, the raised portion of power switch 26 is depressed upward, thus making contact with the printed circuit board and closing the switch 26 to activate apparatus 10. As an example, power switch 26 is fabricated from a thin strip of steel that has been tempered so as to produce a spring. The spring keeps switch 26 open until the bill of hat 14 pushes against it and causes it to complete the circuit via a pad located on the bottom side of the printed circuit board.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for selectively detecting undesirable head movement relative to an address position, said golfer swinging a golf club from the address position to strike a ball, said apparatus comprising:

a movement switch adapted to be positioned on the golfer's head, said movement switch providing an electrical movement signal indicative of movement of the golfer's head from a first position to a second position, said movement switch when positioned on the golfer's head defining the first position as approximately the address position of the golfer's head prior to swinging the golf club;

a transducer for detecting the sound of the golf club striking the ball and providing an electrical activate signal in response thereto; and a microcontroller having a sleep mode for conserving power, said microcontroller receiving and responsive to the activate signal from the transducer to become active from the sleep mode when the golf club strikes the ball, said active microcontroller receiving and responsive to the movement signal for generating an electrical alarm signal when the movement switch indicates movement of the golfer's head from the first position to the second position, said transducer being energized by the alarm signal generated by the microcontroller for producing an audible alarm to inform the golfer of the undesirable head movement during the golf swing, said microcontroller being responsive to the alarm signal for returning to the sleep mode following the audible alarm.

2. The apparatus of claim 1 wherein the alarm signal is a series of electrical pulses provided to the transducer, said pulses energizing the transducer to emit a corresponding series of sound pulses.

3. The apparatus of claim 2 wherein the corresponding series of sound pulses comprise three intermittent tones.

4. The apparatus of claim 1 wherein the transducer comprises a piezoelectric element for converting ultrasonic waves from the golf club striking the ball to the transducer signal and for converting the alarm signal to ultrasonic waves to produce the audible alarm.

5. The apparatus of claim 1 wherein the movement switch is moveable from an open position to a closed position in response to movement of the golfer's head from the first position to the second position.

6. The apparatus of claim 5 wherein the movement switch comprises a mercury switch, said mercury switch being positioned at an angle relative to the address position so that the mercury switch is in its open position when the golfer's head is in the first position and in its closed position when the golfer's head is in the second position.

7. The apparatus of claim 1 further comprising a housing for enclosing the microcontroller, movement switch and transducer, said housing including a clip for securing the housing to a hat to be worn on the golfer's head.

8. The apparatus of claim 7 wherein the clip is biased toward a closed position and moveable from the closed position to an open position for engaging the golfer's hat and securing the housing thereto and further comprising a power switch connected in series between the microcontroller and a battery, said power switch being closed by the clip when the clip is in its open position to connect the microcontroller to the battery for supplying power to the microcontroller.

9. Apparatus for selectively detecting undesirable head movement of a golfer relative to an address position, said golfer swinging a golf club from the address position to strike a ball, said apparatus comprising:

a housing, said housing including a clip for securing the housing to a hat to be worn on the golfer's head, said clip being biased toward a closed position and moveable from the closed position to an open position for engaging the golfer's hat and securing the housing thereto;

a movement switch in the housing, said movement switch providing an electrical movement signal indicative of movement of the housing from a first position to a second position, said movement switch being positioned within the housing and said housing when secured to the hat on the golfer's head defining the first position as approximately the address position of the golfer's head prior to swinging the golf club;

a microcontroller receiving and responsive to the movement signal for generating an electrical alarm signal when the movement switch indicates movement of the golfer's head from the first position to the second position;

a power switch in the housing connected in series between the microcontroller and a battery, said power switch being closed by the clip when the clip is in its open position to connect the microcontroller to the battery for supplying power to the microcontroller; and a transducer being energized by the alarm signal generated by the microcontroller for producing an audible alarm to inform the golfer of the undesirable head movement during the golf swing.

* * * * *